United States Patent [19]

Gassie

[11] 3,930,745

[45] Jan. 6, 1976

[54] FLUID PUMPS

[76] Inventor: Donald V. Gassie, 316 Roosevelt St., Lafayette, La. 70501

[22] Filed: Dec. 20, 1974

[21] Appl. No.: 534,842

[52] U.S. Cl. ..... 415/141; 415/202

[51] Int. Cl.[2] ..... F04D 5/00

[58] Field of Search ..... 416/111, 119; 415/2, 3, 415/4, 7, 141, 202; 417/331, 336

[56] References Cited

UNITED STATES PATENTS

| | | | |
|---|---|---|---|
| 104,603 | 6/1870 | Knowlton | 416/111 |
| 159,127 | 1/1875 | Vater | 416/111 |
| 271,824 | 2/1883 | Figge | 416/111 |
| 526,533 | 9/1894 | Knapp | 416/111 |
| 1,580,807 | 4/1926 | Borden | 415/7 |

FOREIGN PATENTS OR APPLICATIONS

| | | | |
|---|---|---|---|
| 683,228 | 2/1930 | France | 415/2 |

*Primary Examiner*—Henry F. Raduazo

[57] ABSTRACT

A double action fluid pump consisting of the combination of a rotor with multiple blades feathered at an angle perpendicular to the fluid surface, all enclosed within a casing which is contoured to the said rotor-blade assembly and its its related fluid movement area, said casing having a main suction chamber and a discharge chamber in line with each other and in line with the lower one third periphery of the rotor which requires the fluid to flow in a straight line through the pump. A supplementary suction chamber is located in the upper quadrant of the casing on its discharge side which furnishes additional fluid to the main suction chamber to balance the vacuum-pressure relationship of the two suction chambers and cause a rise of pressure behind the blade travel path, thereby minimizing or eliminating blade cavitation as well as increasing the supply and momentum of fluid through the main suction chamber.

1 Claim, 1 Drawing Figure

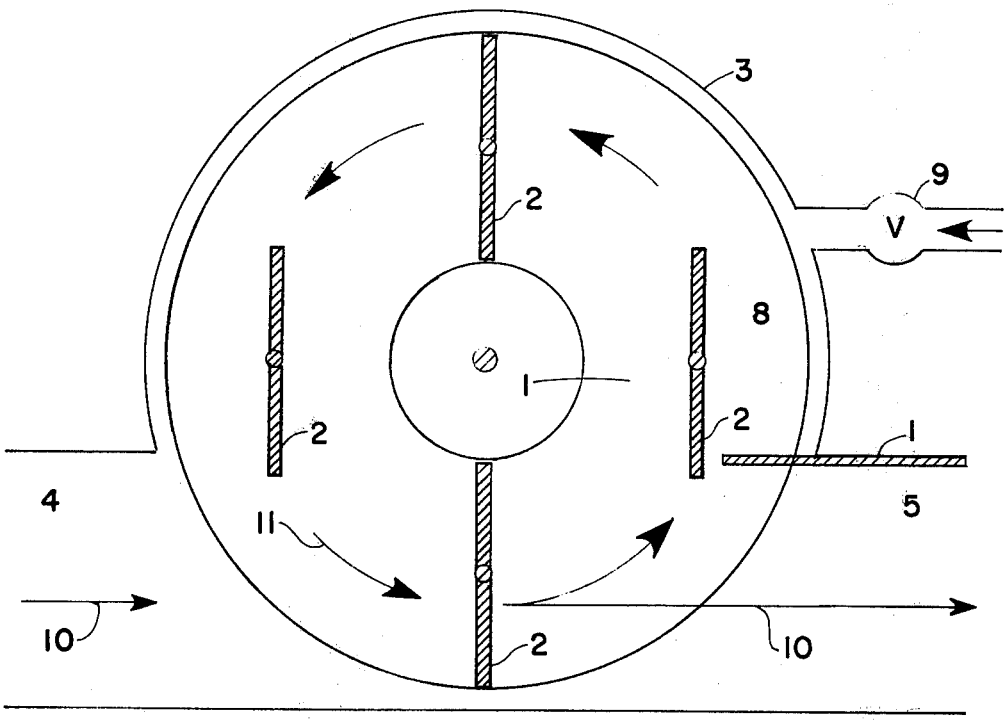
3
9
V
2
8
1
2
2
1
4
5
11
10
2
10

FLUID PUMPS

CROSS REFERENCE

Application for Letters Patent by Donald V. Gassie, dated April 4, 1974, Ser. No. 458,763 (Fluid Pumps). This application is not part of referenced material, but results from sufficient additional information to justify a separate application without disturbing the status of the referenced application.

The present invention relates to double action fluid pumps and consists of the combination of a rotor formed by two discs mounted in parallel on a common axle. Multiple feathering blades on their own axles are mounted between the said discs on bearings in each of the discs. The outer edges of the blades, when in direct line with the rotor axle, are even with and at right angles to the periphery of the discs. The said rotor and blade assembly is installed within a casing contoured to the said rotorblade assembly and its related fluid movement area. The casing has a main suction chamber and a discharge chamber with inlets and outlets in line with each other and in line with approximately one third of the lower periphery of the said rotor. The cross section shapes of the said main suction and discharge chambers and their openings may be of any practical shape that will duct fluids in a laminar fashion. Bearings are installed on the walls of the said casing or its sub-structure to support the rotor axle. A vane is installed as the upper wall of the discharge chamber, its width being the tolerable distance between the said two discs, and extending from the discharge chamber outlet to a point adjacent to the furthest point of blade travel in the direction of the discharge inlet. This vane serves as a guide to fluid flow. A supplementary suction chamber is formed in the upper quadrant of the casing on its discharge side with the said vane serving as its lower wall with its inlet located approximately one third the distance of the rotor diameter above the said vane. A fluid control valve is installed outside of the said inlet of the supplementary suction chamber, and hydraulicly connected to the said inlet. The feathering of the said blades may be accomplished by any conventional method, all with the idea of feathering the blades so they will enter and emerge from the fluid in a perpendicular or near perpendicular angle to the fluid surface line, and upon rotation of the rotor will cause the blades to rotate on their own axles but remain at the same plane angle throughout the entire revolution of the rotor. The FIGURE is a sectional view of the invention.

This invention consists of the combination of nine main components, some of which, with their operational flow plan, are schematically shown on the accompanying drawing, namely; (1) a rotor formed by two discs mounted in parallel on a common axle; (2) Multiple feathering blades on their own axles are mounted between the said discs on bearings in each of the discs, with the outer edge of the blades, when in direct line with the rotor axle, are even with and at right angles to the periphery of the discs; (3) a casing in which the said rotor-blade assembly is installed, and which is contoured to the said rotor and its related fluid movement area. The casing has a main suction chamber (4) and a discharge chamber (5) with their inlets and outlets in line with each other and in line with approximately one third of the lower periphery of the said rotor. Bearings are installed on the casing walls or sub-structure to support the rotor axle; (6) a blade feathering system (not shown because it may be any of several of the systems previously invented and used); (7) a vane forming the upper wall of the discharge chamber and extending between the said discs from the outlet of the discharge chamber toward and to a point adjacent to the furthest point of blade travel in the direction of the discharge chamber inlet; (8) a supplementary suction chamber which is located within the upper quadrant on the discharge side of the said casing with the said vane serving as its lower wall, and its inlet through the casing wall at a point approximately one third the distance of the rotor diameter above the said vane; (9) a fluid control valve is installed outside of and hydraulically connected to the said inlet. Arrows (10) shows the direction of fluid flow and at (11) the direction of rotor rotation.

In operation, the device is so situated where the fluid level is level with or higher than the top of the main suction chamber inlet, with the duct from the supplementary suction chamber also being immersed in the fluid, but at a point away from the main suction chamber inlet. The rotor assembly is then rotated in a direction away from the main suction chamber toward the discharge chamber area. The blades, while rotating on their own axles, retain their perpendicular angles to the fluid surface to enter and emerge from the fluid at the same angles. This will cause the fluid to flow straight through the main suction chamber and out of the discharge chamber outlet. At the same time, as each blade moves away from the supplementary suction chamber, a vacuum is formed which sucks fluid into this area through the supplementary suction chamber inlet and its valve. The blade following will sling this fluid thus sucked against the inner portion of the casing where it will follow the casing wall and enter the main suction chamber in a direction slightly downward and with the direction of flow within the said main suction chamber. The resultant of these forces is a direct reactive thrust between the device and the fluid flowing through it. The supplementary suction chamber and its related fluid movements to the main suction chamber have the effect of preventing or minimizing any cavitation near the blades by increasing the pressure behind the said blades, as well as increasing the supply and momentum of the fluid through the main suction chamber. The control valve is utilized to balance the vacuum-pressure relationship between the supplementary suction and the outfall of its fluids into the main suction chamber. A prototype of this fluid pump was tested as a watercraft propulsor, and the various tests therewith have proven that the foregoing operational data is correct. A photograph of a portion of this operation is attached.

While this invention has been described with particular reference to the construction and operation shown in the accompanying drawing and explained in the specifications and while various changes may be made in the detailed construction, it shall be understood that such changes shall be within the spirit and scope of the present invention as defined by the following claim.

Having thus completely and fully described the invention, what is now claimed and desired to be protected by Letters Patent of the United States of America:

1. A double action fluid pump which consists of the combination of the nine following main components, viz; a rotor formed by two discs mounted in parallel on a common axle; multiple feathering blades on their own axles mounted between the said discs on bearings in each of the discs, with the outer edges of the blades, when in direct line with the said rotor axle, are even with and at right angles to the periphery of the said discs; a casing in which the said rotor-blade assembly is installed on bearings at the said casing's side, said casing being contoured to the said rotor and its related fluid movement area, and having a main suction chamber and a discharge chamber with their inlets and outlets in line with each other and in line with approximately one third of the lower periphery of the said rotor; a conventional blade feathering system; a vane forming the upper wall of the discharge chamber and extending from the outlet of the discharge chamber toward and to a point adjacent to the furthest point of blade travel in the direction of the discharge chamber inlet; a supplementary suction chamber which is located within the upper quadrant on the discharge side of the said casing, with the said vane serving as its lower wall, and its inlet through the casing wall at a point approximately one third the distance of the rotor diameter above the said vane; and a fluid control valve located outside of and connected hydraulically to the said supplementary suction chamber inlet.

* * * * *